United States Patent [19]

Poulose et al.

[11] Patent Number: 4,716,911

[45] Date of Patent: Jan. 5, 1988

[54] METHOD FOR PROTEIN REMOVAL FROM TOBACCO

[75] Inventors: A. J. Poulose, San Bruno; Stanley E. Mainzer, Burlingame, both of Calif.

[73] Assignee: Genencor, Inc., South San Francisco, Calif.

[21] Appl. No.: 849,575

[22] Filed: Apr. 8, 1986

[51] Int. Cl.[4] ..... A24B 15/20

[52] U.S. Cl. ..... 131/297; 131/248; 131/308; 131/309; 131/310

[58] Field of Search ..... 131/308, 309, 297, 298, 131/310

[56] References Cited

U.S. PATENT DOCUMENTS 4,407,307 10/1983 Gaisch et al. ..... 131/308

4,607,646 8/1986 Lilly, Jr. et al. ..... 131/309

*Primary Examiner*—V. Millin

*Attorney, Agent, or Firm*—Ciotti & Murashige, Irell & Manella

[57] ABSTRACT

An improved process for removing insoluble nitrogen-containing compounds from cured tobacco uses alkali or a combination of protease and nonprotease depolymerase, rather than simple protease extraction.

The method of the invention is more efficient and results in a more effective extraction of protein.

24 Claims, No Drawings

METHOD FOR PROTEIN REMOVAL FROM TOBACCO

TECHNICAL FIELD

The invention relates to the processing of tobacco. In particular, it relates to removing protein from the tobacco without adversely affecting the flavor.

BACKGROUND ART

Processing of tobacco is largely an empirical process which includes curing the green tobacco to obtain a cured brown, typically comminuted, preparation which is then aged.

U.S. Pat. No. 4,407,307 to Gaisch et al discloses a form of the process in which cured tobacco is first extracted in the presence of protease for removal of protein and smaller nitrogen-containing substances, the extract subjected to treatment with microorganisms to assimilate proteinaceous and nitrogen-containing compounds, and then, after removing the biomass obtained, resupplying the treated solution to the tobacco so that flavor components not assimilated by the microorganisms are restored to the finished product.

The Gaisch et al process thus approaches the problem of extracting only selected components from the tobacco while permitting the tobacco to retain others by extracting all materials soluble in the presence of enzyme, but permitting microorganisms to effect a useable separation between desirable and undesirable components. Disadvantages of the Gaisch process include the expense required and the relative inefficiency in extracting all nitrogen-containing materials. The present invention offers an improvement in the Gaisch process which partially substitutes treatment with base for treatment with enzyme to achieve a similar end at considerably less cost; by correct adjustment of the conditions, the process is also made more effective. In addition, the present invention provides a more effective alternative to the Gaisch process using a polymerase of plant polymers, such as a carbohydrase in addition to the protease.

As disclosed by Gasich, green tobacco offers no problem with respect to solubility of the protein components, but the extraction is not desirable before curing because the curing process itself is benefited by the presence of what would otherwise be extracted. However, the curing process also evidently converts most of the soluble nitrogen-containing materials of the green leaf to an insoluble form. This insoluble form can, it has now been found, be effectively extracted with dilute base or by the combination of a protease and carbohydrase.

DISCLOSURE OF THE INVENTION

The invention provides an alternative, less expensive, and/or more effective way to extract nitrogen-containing components such as protein from cured tobacco preparations. In one embodiment, the extract is prepared using alkali. The extract may then be treated to neutralize the base and subjected to the action of microorganisms to obtain a suitable flavor component extract, free of protein, to be added back to the tobacco. In another embodiment, the extract is prepared using a combination of protease and a depolymerase such as a carbohydrase. In this case, too, the extract is sterilized, modified with nutrients, and treated with a microorganism culture.

In one aspect, the invention is directed to a process for deproteinizing cured tobacco which comprises treating said tobacco with a solution containing an effective amount of base, e.g., hydroxide ion concentration equivalent to 0.5–1.5% potassium hydroxide. In another aspect, the invention relates to deproteinize cured tobacco which comprises treating an aqueous suspension of the tobacco with both a protease and a nonprotease depolymerase. Both treatments can be used sequentially or various configurations employed. Further steps may be included in the process to obtain a protein-free solution for restoring the flavoring components of the preparation.

MODES OF CARRYING OUT THE INVENTION

The process of the invention, in general, follows the procedures set forth in U.S. Pat. No. 4,407,307, incorporated herein by reference, except that rather than utilizing solubilizing proteases such as trypsin, pronase, or pepsin, either a combination of such protease with an effective amount of a depolymerase such as carbohydrase, or a solution containing a hydroxide ion concentration equivalent to 0.5–1.5% potassium hydroxide is used.

If an enzyme combination is used, a more effective extraction of the nitrogen-containing components is achieved. The protease may be selected from a variety of conveniently obtainable enzymes, and may include those disclosed by Gaisch. Examples of such proteases include dispase, protease K, pronase, thermolysin, trypsin, chymotrypsin, bromelain, subtilisin, and the various Rhozyme proteases. The polymerase enzyme is an enzyme capable of cleaving biological polymers but does not utilize polypeptides or proteins as a primary substrate. Such enzymes are hydrolytic with respect to, for example, cell walls or other structural polymers such as cellulose or with respect to nutritive polymers such as lipids or starch. The depolymerase enzyme is also selected from a number of alternatives which alternatives include cellulase, pectinase, lipase, ligninase, cutinase, and amylase, preferably pectinase. The conditions for extraction with the enzyme combination are generally those used for extraction with the protease alone, although modifications are of course made to accommodate the specific pH and temperature characteristics of the particular enzymes chosen.

If alkali extraction is used, it is understood that alternative compounds to potassium hydroxide, which is most preferred, can be used to obtain the desired concentration of base. Sodium hydroxide, for example, could also be used and smaller percentages would be required in view of its lower molecular weight. However, while workable, sodium hydroxide is somewhat less desirable due to the relative insolubility of sodium salts as compared to potassium salts of some organic compounds. Ammonium hydroxide is also favored, as it is easily removed through vaporization. Other alternatives include phosphate and carbonate salts although their indirect mechanism to obtain highly basic solutions necessitates disadvantageously larger amounts of base. However, the use of these bases is not preferred chiefly for economic reasons, and, in proper amount, they are operable in the method of the invention.

Of course, both alkali and enzyme extraction may be used in sequence, if desired. Suitable adjustment of conditions is required. In addition, certain depolymerases and certain proteases may be stable in the presence of alkali; if so, simultaneous conduct of both aspects of the invention is feasible. In such instances, also, the protease and alkali treatments may be concurrent.

Treatment of the finely divided cured tobacco according to the invention is conducted in a volume ratio of aqueous phase to tobacco of approximately 5–10 to 1. Higher ratios of aqueous solution up to approximately 20 to 1 are possible, but this results in a diluted solution of flavoring components after microorganism treatment. Lower ratios of aqueous to tobacco may also be used down to a ratio of approximately 3:1 where even theoretically solubilized components begin to lose their solubility due to concentration levels obtained. A particularly preferred ratio is on the order of 5:1 which affects a reasonable balance between dilution of the flavoring elements and solubilization of the materials desired to be extracted when comminuted cured tobacco is used.

Other factors in the extraction process which are variable and need to be optimized according to the particular conditions of the extraction include time of incubation, temperature, and concentration of enzymes or of base. Generally, for the extraction using enzymes, temperatures of room temperature to about 70° C. are preferred, and the extraction takes place over at least 6–15 hours. The amounts of enzymes added depends on the purity of the enzyme preparations and on the activity thereof. For extraction using alkali, temperatures above about 50° C. are preferred and incubation times are of approximately 2 to 8 hours.

In addition to comminuted cured tobacco, larger sections of leaf may also be used such as strips, whole leaves, or a coarsely chopped preparations. These factors also affect the time, temperature, and reagent (enzyme or alkali) concentration required as well as the ratio of aqueous phase to tobacco.

It will be apparent that foregoing variables are interrelated. For example, for alkali extraction, the more finely divided the tobacco leaf and the higher the temperature of extraction, the shorter the time for incubation required. On the other hand, lower temperatures require longer incubation times as do tobacco preparations which have less surface area.

After incubation in the solution containing the enzyme mixture or in the potassium hydroxide or equivalent solution for the optimum time period the extraction procedure is stopped using appropriate means. The optimum time of incubation can be determined by tracking the level of protein in the extract using standard procedures for protein determination, such as those of Lowry, O. H., et al, *J Biol Chem* (1951) 193:265–275, or Kjeldahl nitrogen determination.

The tobacco is recovered from the supernatant solution and washed with water, preferably at 80° C., to remove excess enzyme or hydroxide. If base is used, and if desired, the basic extract is neutralized using suitable dilute acid, for example acetic or hydrochloric acid or by other means known per se in the art. The neutralized extract may then be sterilized and inoculated with a culture of microorganisms having the capacity to assimilate protein and protein subunits. Addition of sugar as a major carbon source and of other nutrients may also be necessary. After growing the microorganism through exponential growth phase, the biomass is removed by centrifugation or other means to obtain a supernatant reduced in the nitrogen-containing compounds in the extract, but retaining the flavor components. The resulting biomass-free solution is then concentrated if necessary and used to treat either the specific tobacco preparation previously extracted, or another tobacco preparation treated as desired.

Like the Gaisch process, the process of the present invention results in a tobacco which has a protein content of less than 6% of the dry weight, and permits the addition of amadori compounds (desired flavouring compounds formed during curing by reaction of sugars and amino acids) in the desired amounts. However, as compared to the Gaisch process, a more efficient and effective extraction is achieved.

EXAMPLES

The following examples are intended to illustrate but not to limit the invention.

EXAMPLE 1

Control Using Prior Art Process

For comparative purposes, the process as described by Gaisch (supra) was conducted using dispase as the solubilizing enzyme. In five separate determinations, strips of cured tobacco leaves were incubated in a 10:1 aqueous:tobacco ratio for 5 hours at 37° C. before adjusting the pH to 7.5. Dispase (EC 3.4.24.4), obtained from Boehringer Mannheim, Mannheim, Germany was added at a concentration of 1 unit (U)/ml. wherein 1 unit of enzyme activity is as defined by the manufacturer. Incubation was continued for 16 hours at 37° C. The protein content of the extracts was then determined.

When no enzyme was added to the solution, 52.9 mg/g dry weight of tobacco was extracted into the supernatant or 32% of the extractable protein.

When dispase was added, 62.6 mg/g tobacco was extracted or 38% of total extractable protein.

EXAMPLE 2

Effect of Carbohydrase Addition

The extraction was conducted in five separate determinations, exactly as described in Example 1, except that 150 APU/ml of pectinase (EC 3.2.1.15) obtained as Pectinol 59-L from Genencor, South San Francisco, CA, was added to the mixture along with the dispase. (APU is apple pomace unit, as defined by the manufacturer.)

When dispase plus pectinase were added 68.5 mg/g tobacco or 42% of the total extractable protein was obtained, showing an improvement in the amount of total protein extracted over that obtained with dispase alone.

EXAMPLE 3

Solubilization Using Alkali

Tobacco leaves were treated as set forth in Examples 1 and 2, except that in place of enzyme(s), the extracting solution was made 0.5% or 1.0% in potassium hydroxide. Protein determinations on the extract were made using the method of Lowry; these results were confirmed by analysis of the remaining protein in tobacco using amino acid analysis, Lowry assay, Kjeldahl nitrogen determination, and analysis for primary amino groups.

For no additions to the extract, the percent of total extractable proteins obtained in the extract was again approximately 33%.

When 0.5% potassium hydroxide was used as the extracting solution, 44% of total extractable proteins was obtained.

When 1% potassium hydroxide was used as the extracting solution, 57% of total extractable proteins was obtained.

EXAMPLE 4

Effect of Variation of Persent Potassium Hydroxide

The process of Example 3 was repeated using varying percentages of potassium hydroxide in the extracting solution. The results are shown in Table 1.

TABLE 1

| % KOH | % Protein Extracted |
|---|---|
| 0.0 | 35 |
| 0.1 | 37 |
| 0.2 | 40 |
| 0.3 | 41 |
| 0.4 | 44 |
| 0.5 | 44 |
| 0.6 | 48 |
| 0.7 | 50 |
| 0.8 | 55 |
| 1.0 | 50 |

The results show an optimum potassium hydroxide concentration of 0.8%; the results are in agreement with those of Example 3 within experimental error.

EXAMPLE 5

Effect of Time and Temperature of Incubation

Various incubation conditions were assessed using 1% KOH (with water as a control) to evaluate optimum conditions for maximum extraction of the nitrogen-containing materials. Assays of the supernatant were made by Lowry determinations as above. The results are shown in Table 2.

TABLE 2

| | | % Protein Extracted | |
|---|---|---|---|
| Time | Temperature | 0% KOH | 1% KOH |
| 1 hr | 37° | 32 | 44 |
| 1 hr | 50° | 34 | 45 |
| 2 hr | 37° | 35 | 44 |
| 2 hr | 50° | 42 | 48 |
| 3 hr | 37° | 35 | 44 |
| 3 hr | 50° | 38 | 60 |
| 6 hr | 37° | 30 | 44 |
| 6 hr | 50° | 38 | 57 |
| 8 hr | 37° | 38 | 52 |
| 30 hr | 22° | 38 | 50 |
| 30 hr | 37° | 41 | 52 |
| 54 hr | 22° | 40 | 55 |
| 54 hr | 37° | 32 | 50 |

These results show optimum extraction after about three hours at 50° C. Additional time periods improve the level of extraction, in general, at a given temperature.

EXAMPLE 6

Characterization of the Remaining Nitrogen-Containing Materials

The amino acid content remaining in the leaf was analyzed to determine whether preferential extraction for particular amino acids was being effected. The procedure was as in Example 1 using both 0% and 1% KOH.

The results show that both water and 1% KOH extraction resulted in preferential removal of polar and charged amino acids (Asx, Glx, Lys, Arg, His, Ser, Thr, Cys, Met, Pro, OH-Pro); water extraction removed 44% of these amino acids; 1% KOH removed 63%.

The hydrophobic amino acids on the other hand (Gly, Ala, Val, Leu, Ile, Phe, Tyr) were less effectively removed. Water extracted only 19% of these amino acids; 1% KOH only 39%.

The ratio of charged and polar amino acids to uncharged and hydrophobic amino acids in unextracted leaves was 1.6:1; in the water extracted leaves, this ratio was 1.1:1; in the base-extracted leaves, this ration was 0.9:1.

Amino acid analysis of the extracted leaves was conducted using a Beckman 6300 amino acid analyzer.

We claim:

1. In the process for treatment of tobacco comprising the steps of subjecting cured tobacco to treatment with aqueous medium whereby insoluble nitrogen-containing components are solubilized and separated from the tobacco residue, the improvement which comprises utilizing as said aqueous medium an aqueous medium containing hydroxide ion equivalent to 0.5–1.5% potassium hydroxide.

2. The process of claim 1 wherein the hydroxide ion concentration is equivalent to 0.8% KOH.

3. The process of claim 1 wherein the ratio of aqueous medium to cured tobacco is 5:1–10:1.

4. The process of claim 1 wherein the treatment is for 1–6 hours at 22°–70° C.

5. The process of claim 1 wherein the tobacco residue has a higher ratio of uncharged and hydrophobic to polar and charged amino acids than the unextracted cured tobacco.

6. In the process for treatment of tobacco comprising the steps of subjecting cured tobacco to treatment with aqueous medium containing a protease whereby insoluble nitrogen-containing components are solubilized and separated from the tobacco residue, the improvement which comprises including in the aqueous medium an effective amount of a non-protease depolymerase.

7. The process of claim 6 wherein said depolymerase is selected from the group consisting of pectinase, cellulase, and cutinase.

8. The process of claim 6 wherein the ratio of aqueous medium to cured tobacco is 5:1–10:1.

9. The process of claim 6 wherein the treatment is for 1–26 hours at 22°–70° C.

10. The process of claim 6 wherein the tobacco residue has a higher ratio of uncharged and hydrophobic to polar and charged amino acids than the unextracted cured tobacco.

11. A process of curing tobacco which comprises contacting cured tobacco leaves or fragments thereof with an amount of aqueous alkali effective to extract nitrogen-containing components from the tobacco.

12. The process of claim 11 wherein the hydroxide ion concentration is equivalent to 0.8% KOH.

13. The process of claim 11 wherein the ratio of aqueous medium to cured tobacco is 5:1–10:1.

14. The process of claim 11 wherein the treatment is for 1–6 hours at 22°–70° C.

15. The process of claim 11 wherein after said contacting, the tobacco leaves or fragments have a higher ratio of uncharged and hydrophobic to polar and charged amino acids than prior to said treating.

16. The process of claim 11, wherein the nitrogen-containing components are proteinaceous.

17. The process of claim 11, wherein the aqueous alkali is a solution containing an alkaline component selected from the group consisting of potassium hydroxide, sodium hydroxide, phosphate salts and carbonate salts.

18. A process for curing tobacco which comprises contacting cured tobacco leaves or fragments thereof with an amount of an enzyme mixture comprising a protease and a nonprotease depolymerase effective to extract nitrogen-containing components from the tobacco.

19. The process of claim 18 wherein said depolymerase is selected from the group consisting of pectinase, cellulase, and cutinase.

20. The process of claim 18 wherein the ratio of aqueous medium to cured tobacco is 5:1–10:1.

21. The process of claim 18 wherein the treatment is for 1–26 hours at 22°–70° C.

22. The process of claim 18 wherein after said contacting, the tobacco leaves or fragments have a higher ratio of uncharged and hydrophobic to polar and charged amino acids than prior to said treating.

23. A process for curing tobacco which comprises contacting cured tobacco leaves or fragments thereof with an amount of an alkaline aqueous medium and with an amount of an enzyme mixture comprising a protease and a nonprotease depolymerase effective to extract nitrogen-containing components from the tobacco.

24. The process of claim 23, wherein the alkaline aqueous medium and enzyme mixture are used in sequence.

* * * * *